United States Patent [19]

Christ et al.

[11] 4,084,019

[45] Apr. 11, 1978

[54] ELECTROSTATIC COATING GRID AND METHOD

[75] Inventors: Christy Christ, Trenton; Hart F. Graff, Middletown, both of Ohio

[73] Assignee: ARMCO Steel Corporation, Middletown, Ohio

[21] Appl. No.: 655,460

[22] Filed: Feb. 5, 1976

[51] Int. Cl.[2] ..... B05D 1/06; B05B 5/02

[52] U.S. Cl. ..... 427/32; 118/627; 118/638; 118/DIG. 5; 361/226; 427/21; 427/27

[58] Field of Search ..... 427/32, 33, 27, 21; 317/3, 4, 262 A, 2 F; 96/1 C; 118/627, 630, DIG. 5, 638; 428/256; 361/225, 226

[56] References Cited

U.S. PATENT DOCUMENTS

| | | | |
|---|---|---|---|
| 2,421,787 | 6/1947 | Helmuth | 427/32 |
| 2,503,224 | 4/1950 | Trump et al. | 317/262 A X |
| 2,625,590 | 1/1953 | Peeps | 118/627 X |
| 2,758,535 | 8/1956 | Roberts | 118/627 X |
| 2,889,805 | 6/1959 | Freeder | 118/627 |
| 3,248,253 | 4/1966 | Barford et al. | 427/33 |
| 3,336,903 | 8/1967 | Point | 118/624 |
| 3,566,833 | 3/1971 | Beebe et al. | 118/634 |
| 3,672,927 | 6/1972 | Spiller et al. | 427/32 |

*Primary Examiner*—Ronald N. Smith
*Assistant Examiner*—Stuart D. Frenkel
*Attorney, Agent, or Firm*—Melville, Strasser, Foster & Hoffman

[57] ABSTRACT

A power grid for a fluidized bed for electrostatically depositing a powdered plastic coating material from the bed onto an elongated metal substrate moving in a path of travel above the upper surface of the bed on a substantially horizontal pass line. The power grid includes two co-planar wire mesh elements positioned beneath the surface of the bed, the elements having opposed edges in parallel spaced relationship and defining a gap therebetween beneath the pass line. The edges are upturned to form a plurality of electrode segments, the tips of the electrode segments being substantially coincident with the upper surface of the bed when energized. In operation the electrode segments form a row of localized corona discharges to either side of the passing substrate to effect electrostatic deposition of a thin uniform film coating of the powdered material thereon.

6 Claims, 4 Drawing Figures

ELECTROSTATIC COATING GRID AND METHOD

BACKGROUND OF THE INVENTION

1. Field of the Invention

The present invention relates to the coating of objects by the electrostatic deposition of particles thereon and more particularly pertains to a grid for establishing an electrostatic field of high intensity and controlled geometry.

2. Description of the Prior Art

It is well known in the art to utilize an electrostatic fluidized bed for the electrostatic deposition of particles on a variety of objects. In operation powdered plastic coating material from a conventional fluidized bed reservoir is given an electrostatic charge by suitably arranged corona discharges, and is attracted to an appropriately biased metallic substrate. The powder-coated substrates are subsequently heated or otherwise treated so as to cause the plastic powder to flow into a dense coating layer and to cure.

While electrostatic fluidized beds in general have been satisfactorily used to coat a variety of objects, providing relatively uniform coatings on substrates of complex shape, difficulties have been encountered in achieving this uniformity. This is so because the charged particle motions are determined by the electric field which exists in the space between the fluidized bed and the substrate, and by gravity, with the consequence that most of the particles which pass successfully to the substrate do so in a rather direct route, with the charged particles being deposited upon the most accessible area of effectively opposite charge, such that the surfaces of the substrate at different distances from the bed acquire heavy deposits upon their portions closest to the bed while developing progressively thinner coatings on their outer surfaces.

One such method and apparatus is disclosed for example in United States Letters Pat. No. 3,348,243, in the name of J. C. Barford, et al. Electrostatic charging of the fluidized bed particles is accomplished by providing a series of pointed electrodes positioned within the fluidized bed. However, the above mentioned difficulties of uniformity of coating were encountered. Accordingly, methods such as the simultaneous use of a plurality of isolated electrostatic fluidized bed sources appropriately positioned surrounding a suitably charged substrate of complex shape are disclosed.

A United States Letters Pat. No. 3,336,903, in the name of M. A. R. Point, acknowledges that difficulties are encountered in providing adequate control over the spatial extent of the electrostatically charged particles when using electrostatic coating equipment of the Barford, et al type and that the cloud of finely divided coating material to be applied to the surface of the substrate exhibited a tendency to wander. Point endeavored to eliminate this problem by providing auxiliary electrodes to keep the charged particles from wandering.

United States Letters Pat. No. 3,670,699, in the name of Gerald P. Sargent, sought to endeavor to solve the problem of uniform coating by replacing the series of pointed electrodes of Barford, et al with a web of moderately conductive particles or fibers which were incorporated into the porous membrane of an otherwise conventional fluidized bed.

United States Letters Pat. No. 3,828,729, in the name of William C. Goodridge, is exemplary of still a further attempt to solve the uniform coating problem. According to Goodridge, shields are utilized at various points to redistribute the charged particles in a more uniform manner.

However, it is clear that throughout the years substantial difficulties have been encountered in achieving relatively uniform coatings on substrates and to date such difficulties are still being encountered.

SUMMARY OF THE INVENTION

The present invention provides an improved power grid for a fluidized bed for electrostatically depositing a powdered plastic coating material from the bed onto an appropriately biased elongated metal substrate moving in a path of travel above the upper surface of the bed, on a substantially horizontal pass line, the powdered plastic coating material being given an electrostatic charge by corona discharges and being transported electrostatically from the bed onto the substrate. In its broadest application, the power grid comprises two co-planar wire mesh elements positioned beneath the surface of the bed, the elements having opposed edges in parallel spaced relationship and defining a gap therebetween beneath the pass line. The edges of the wire mesh elements are upturned to form a plurality of electrode segments, the tips of the electrode segments being substantially coincident with the upper surface of the bed when energized. Accordingly, when a potential difference of between 10,000 and 60,000 volts is applied between the power grid and the substrate, corona discharges form on the electrode segment tips, thereby causing a row of localized powder charging corona discharges to either side of the passing substrate to effect electrostatic deposition of a thin uniform film coating of the powdered material thereon.

In a preferred embodiment the co-planar wire mesh elements comprise one half inch by one half inch wire mesh. Additionally, the co-planar wire mesh elements are substantially horizontal and each unturned edge portion is substantially perpendicular to its respective segment.

In another preferred embodiment the upturned edge portions are cut so as to eliminate the longitudinal wire and provide a series of exposed pointed wire ends. Additionally, the exposed wire ends may be identically sharpened, and other sharp protrusions may be removed from the wire elements, so that the position and intensity of the corona discharges can be controlled.

The present invention also provides a method for electrostatically depositing a uniform coating of a thin film of powdered plastic onto an elongated metal substrate, such as a continuous length of wire or tubing complex shape, and the like, which comprises the steps of providing a fluidized bed means including a substantially closed nonconductive container having a passageway for receiving an elongated metallic substrate; conveying the substrate through a passageway of the fluidized bed means in a path of travel above the upper surface of the bed on a substantially horizontal pass line; and forming a row of localized corona discharges to either side of the passing substrate to effect electrostatic deposition of a thin uniform film coating of the powdered material thereon by a powder grid comprising two co-planar wire mesh elements positioned beneath the surface of the bed, the elements having opposed edges in parallel spaced relationship and defining a gap therebetween beneath the pass line and the edges being upturned to form a plurality of electrode segments, the tips of the electrode segments being substantially coincident with the upper surface of the bed when energized.

DESCRIPTION OF THE PREFERRED EMBODIMENTS

Figure 1:
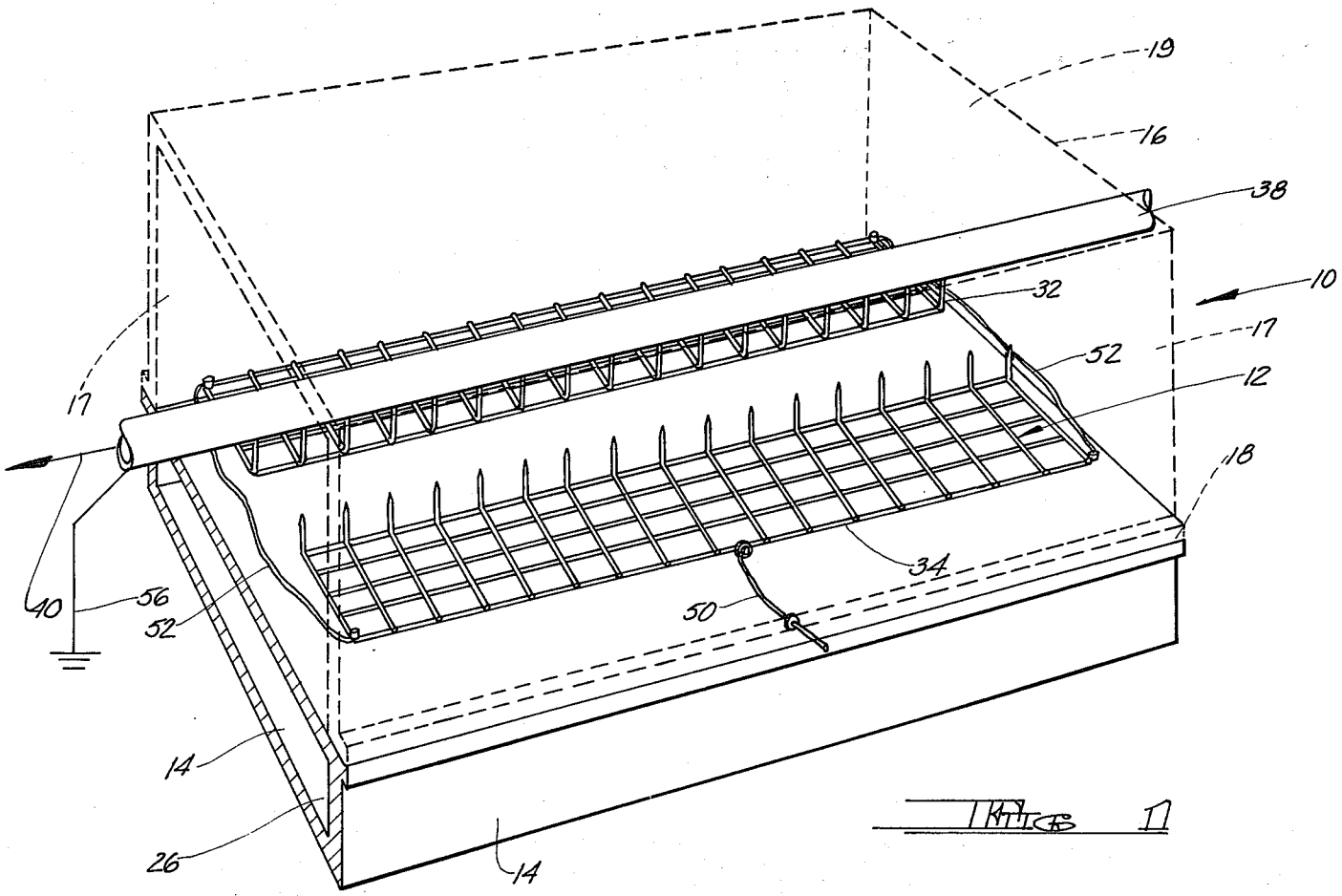
FIG. 1 is a fragmentary, schematic, perspective view of an electrostatic fluidized bed incorporating the power grid of the present invention.
Figure 2:
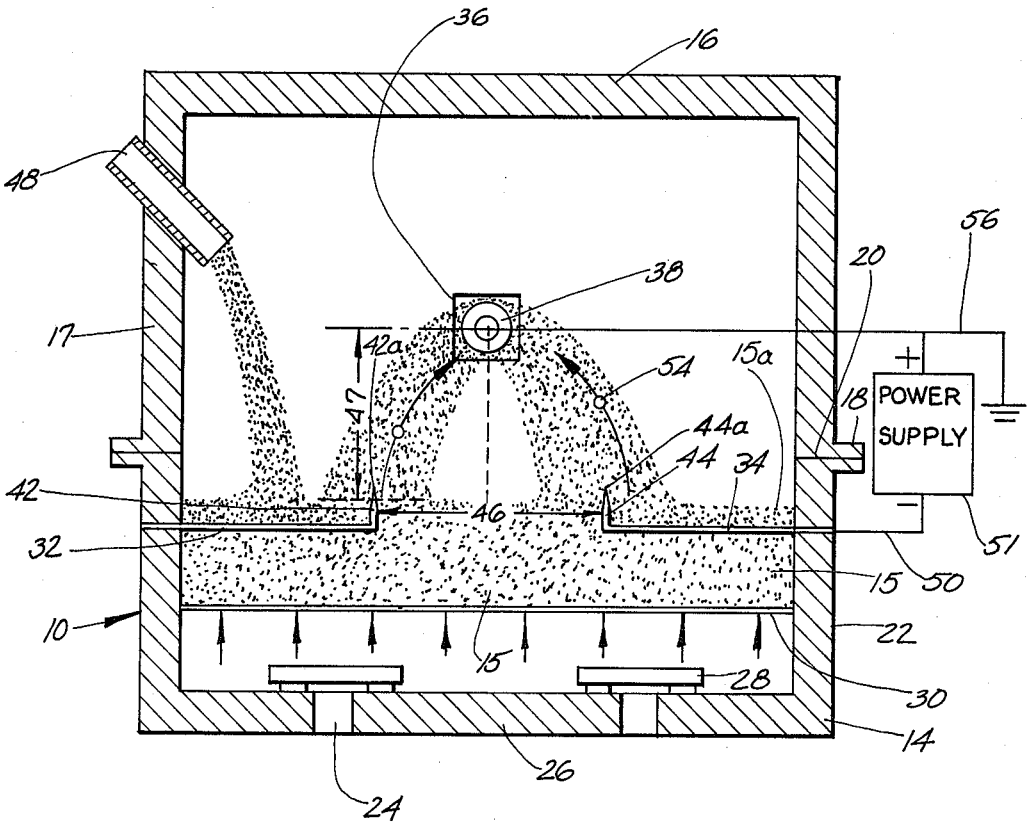
FIG. 2 is a schematic, transverse, cross sectional view taken through the fluidized bed of FIG. 1.
Figure 3:
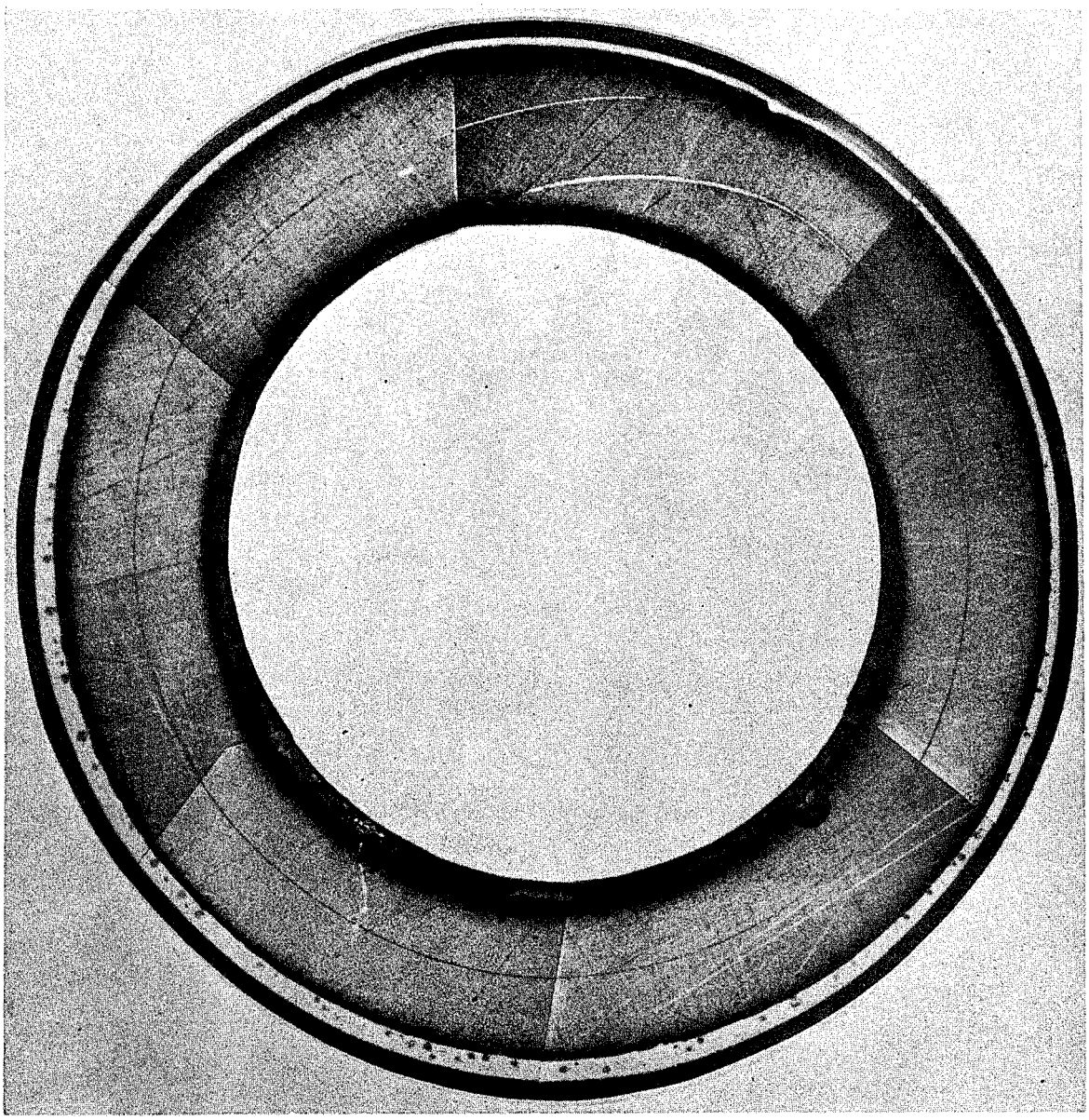
FIG. 3 is a photomicrograph at 32X of a section of epoxy coated tubing not in accordance with the invention.

Turning now to FIGS. 1, 2 and 3 of the appended drawings, an electrostatic fluidized bed 10 incorporating the power grid 12 of the present invention is shown. The electrostatic fluidized bed 10 includes a base 14 and a cover 16, the peripheral flange 18 of which receives the upper edge 20 of the side wall 22 of the base 14. Means (not shown) are provided to vibrate the fluidized bed 10.

As best seen in FIG. 2, air inlet ports 24 extend through the bottom wall 26 of the base 14 and have diffusion plates 28 positioned thereover, the diffusion plates 28 serving to promote distribution along the length of the fluidized bed 10 of air injected through the ports 24.

A fluidized bed membrane 30 joins the side walls 22 of the base 14 and forms the bottom of the reservoir for the bath or bed 15 of powdered plastic coating material.

Since it is important that the cover assembly not be a conducting material, as a conductor would influence the electric field in the vicinity of the substrate, the cover 16, side walls 22 and base 14 should be constructed from non-conductive material. For best performance the cover assembly should be fabricated from a high quality insulating material, such as a high voltage ceramic, as many poor quality insulators are surprisingly conductive at the very high voltages (30 to 70 kv) used in electrostatic fluidized beds.

As can be seen, the cover 16 provides a substantially closed container having a vertical side and end walls 17 and 19, respectively, with each end wall 19 providing a suitable passageway 36 therethrough for receiving an elongated metal substrate, such as continuous lengths of wire, tubing, and the like 38, which is conveyed through the passageway 36 of the fluidized bed 10 in a path of travel above the upper surface of the bath or bed 15 on a substantially horizontal pass line 40 by any well known conveying means (not shown).

The power grid 12 comprises two co-planar wire mesh elements 32 and 34, positioned beneath the surface of the bath or bed 15. The wire mesh elements 32 and 34 are provided with opposed edges 42 and 44, respectively, in parallel spaced relationship and defining a gap 46 therebetween beneath the pass line 40. The edges 42 and 44 are upturned to form a plurality of electrode segments. The tips **42*a* and 44*a* of the electrode segments are substantially coincident with the upper surface of the bath or bed 15** when energized.

A feed conduit 48 is attached to the cover 16 to provide means for furnishing powdered plastic material to the fluidized bed 10 from a reservoir or supply thereof (not shown), and means (also not shown) may be present within the fluidized bed 10 for detecting the quantity of powdered plastic material to automatically control the feed operation on a continuous basis. It will, of course, be understood that the powdered plastic material utilized will depend upon the desired coating on the elongated member 38, and that the powdered plastic material may be, for example, of the thermoplastic or thermosetting type.

Mounted through the cover 16 adjacent the wire mesh segment 34 are cables for appropriate electrical interconnection, the cable 50 being connected to the power source 51 and providing high voltage to the segments 32 and 34, which are electrically interconnected by means of the cable 52, and the cable 56 connected to the elongated metal substrate 38 to appropriately bias the substrate. While a single power source 51 has been shown, it will be understood that each of the segments 32 and 34 could be connected to a separate power source. As previously indicated, the means for conveying the elongated metal substrate through the passageway 36 in each end wall 19 of the cover 16 of the fluidized bed 10 may be of any conventional design.

The appropriately biased (eg, electrically grounded) elongated metal substrate 38 is moving from right to left in a path of travel above the upper surface **15*a* of the bath or bed 15 on a substantially horizontal pass line 40, as indicated by the arrow in FIG. 1. During the operation of the fluidized bed 10, and is best seen in FIG. 2, particles 54 of the powdered plastic coating material in the bath or bed 15 are given an electrostatic charge by corona discharges and are transported from the bath or bed 15 onto the surface of the substrate 38. More particularly, the electrode segments 42 and 44 form a row of localized corona discharges to either side of the passing substrate 38** to effect electrostatic deposition of a thin uniform film of the powdered plastic coating thereon.

It is believed that the sources of the power grid 12 of the present invention in achieving a uniform film coating of powdered plastic material on the elongated metal substrate 38 is a result of the vertical electrode segments 42 and 44. It is believed that the primary coating flux comes from the immediate vicinity of the electrode segments 42 and 44 and from the region or gap 46 therebetween. The gap 46 between the electrode segments 42 and 44 is believed to be important, because heavy particles 54 thrown out of the immediate vicinity of the electrode segments 42 and 44 by space charge effects carry charge into the intermediate region, where it is transferred to lighter particles that are picked up by the electric field and deposited on the underside of the substrate 38. It is believed that the electric wind effect, resulting from the electric field generated by the planar mesh elements of the power grid 12, is a factor in propelling coating particles 54 to the region above the substrate 38, where they are attracted to the substrate 38 by the local electric field adjacent to the surface of the substrate 38 and coat the upper substrate surfaces. It is thought that the electrode segments 42 and 44 play the important role of making the location of the region of primary charging of coating particles relatively insensitive to the discharge power. Thus at low power levels considerably better coating uniformity is achieveable with the power grid 12 of the present invention than with, for example, buried planar screen electrode geometries of the prior art. At high power levels the coating uniformity is less sensitive to the electrode configuration.

In addition, the localized corona discharges on the tips 42a and 44a of the electrode segments 42 and 44, respectively, localize the primary points of charging of the coating particles 54 and thereby remove the necessity of a plurality of isolated fluidized beds as suggested in prior art for obtaining uniform coatings on the sides of a substrate passing above the bed surfaces. The fact that the corona discharges exist at the surface of the fluidized bed rather than beneath the surface reduces the required operating voltage, from the 100,000 to 120,000 volts that are required for some devices which are presently on the market, to values in the range of 30,000 to 70,000 volts. This reduction in voltage considerably reduces the safety hazard in the task of providing suitable insulators.

It should also be noted that it is believed that the near-coincidence of the surface of the bath or bed 15 and the corona discharges on the tips of the vertical electrode segments 42 and 44 makes control of the fluidized bed elevation important. Failure to control the bed height properly appears to cause temporal variations in both the deposition rate and coating uniformity.

The actual position of the electrode segments 42 and 44 of the power grid 12 does not appear to have a critical influence on the coating uniformity, although situations which place the substrate 38 too close to the bath or bed 15 should probably be avoided. Furthermore, the electrode segment geometry does not seem to have a major influence on the deposition rate for a given elevation of the substrate 38 above the bed or bath 15.

It is believed that the planar mesh elements of the power grid 12 should have a mesh spacing that is small compared to the interelectrode spacing. Good results have been achieved in practice when the power grid 12 providing the electrostatic charge in the fluidized bed 10 is constructed of one half inch by one half inch wire mesh in two segments 32 and 34, as previously explained, one on each side of the elongated metal substrate pass line 40, with about 5½ inches between the elements. In addition, it has been found that good results are obtained when the electrode segments 42 and 44 of each grid element 32 and 34, respectively, are bent with a 90° leg, ¾ inch long parallel and adjacent to the pass line 40. Each electrode segment 42 and 44 is preferably cut so as to expose the pointed wire ends of the mesh eliminating the horizontal wire. The two-grid elements 32 and 34 should be connected to a common high voltage (eg, ≦ 70 kv) source and best results are found when the substrate pass line 40 is within the range of about 2¼ inches to 4½ inches above the surface 15a of the bath or bed 15.

Although a leg height of the edge portions 42 and 44 of approximately ¾ inch should be effective for a wide range of operating conditions, it will, of course, be understood that the distance of separation from the pass line 40 is dependent on the height 47 of the elongated member 38 above the bed membrane 30 and the diameter of the elongated member 38.

In a preferred embodiment it was found that the bed membrane 30, in a fluidized bed having a length of approximately 12 inches, contained powder to a depth of five-eighth inch without fluidization. Additionally, it was found that the distance from the top of the membrane 30 to the top of the exposed wire ends of the electrode segments 42 and 44 of the elements 32 and 34, respectively, was 1¾ inches. The pass line of the tubing 38 was such that the bottom of the tubing 38 to the top of the membrane 30 was 4½ inches. The vibrator preferably operated in maximum air capacity of 75 P.S.I.G. Fluidization air was approximately 2½ pounds or enough to raise the level of the powdered plastic material to the top of the edge portions 42 and 44 of the segments 32 and 34, respectively. The high voltage applied to the grid elements 32 and 34 was 32 KV. The number of electrode segments 42 and 44 per unit length was approximately 25 per side and the approximate average corona current per vertical electrode segment 42, 44 (i.e., per corona discharge) at the specified voltage was found to be approximately 1.5 to 2 microamperes per segment. It was found that the deposition rate for a typical material was 25–30 grams per minute on 0.189 inch diameter tubing at 30 feet per minute. The polarity of the applied potential was negative. The powder particle size averaged 35 micron.

Figure 4:
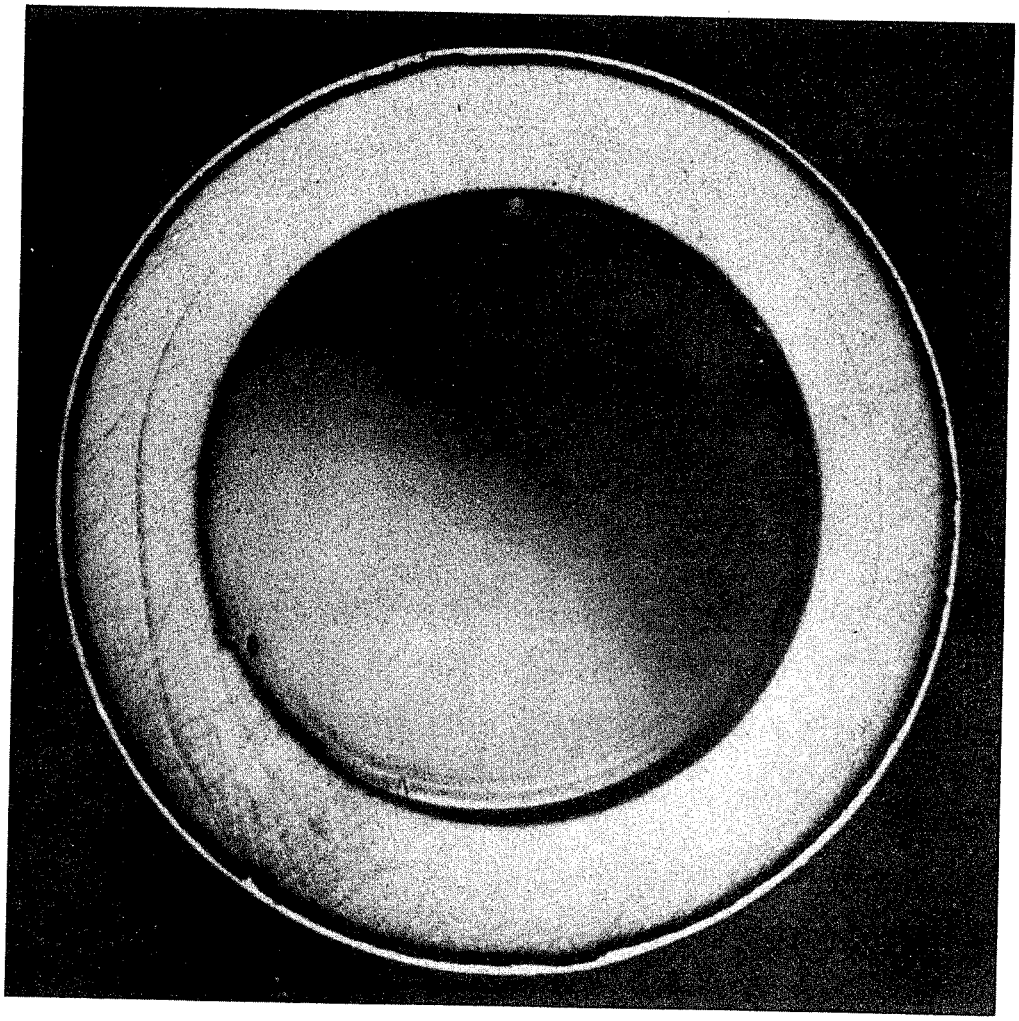
FIG. 4 is a photomicrograph at 36X of a section of epoxy coated tubing in accordance with the teachings of the invention.

Referring now to FIGS. 3 and 4, the advantages of the present invention will be readily apparent. As seen in FIG. 3, a photomicrograph at 32X of a section of epoxy coated tubing utilizing a conventional planar grid, the epoxy coating is not uniform and the surfaces of the tubing at different distances above the bed have acquired heavy deposits upon the lower portions and progressively thinner coatings on the upper surfaces. In contrast, as seen in FIG. 4, a photomicrograph at 36X of a section of epoxy coated tubing utilizing the power grid 12 of the present invention, the thin film coating of epoxy is uniformly disposed around the outer surface of the tubing.

As many possible embodiments may be made of the invention without departing from the scope thereof, it is to be understood that all matter herein set forth or shown in the accompanying drawings is to be interpreted as illustrative and not in a limiting sense.

We claim:

1. A method for electrostatically depositing a uniform coating of thin film of powdered plastic on an elongated metal substrate, which comprising the steps:

(a) providing fluidized bed means including a substantially closed container having a passageway for receiving an elongated metallic substrate;

(b) conveying said elongated metal substrate through the passage way of said fluidized bed means in a path of travel above the upper surface of said bed on a substantially horizontal pass line; and (c) forming a row of localized corona discharges to either side of said passing substrate to effect electrostatic deposition of a thin uniform film coating of said powdered material thereon by a power grid comprising two co-planar wire mesh elements positioned beneath the surface of said bed, said elements having opposed edges in parallel spaced relationship and defining a gap therebetween beneath said pass line, said edges being upturned to form a plurality of electrode segments, the tips of said electrode segments being substantially coincident with the upper surface of said bed when energized.

2. In an apparatus for electrostatically depositing a powdered plastic coating material on an elongated metal substrate, the combination comprising:

(a) fluidized bed means including a substantially closed container having a passage way for receiving an elongated metal substrate moving in a path of travel above the upper surface of the bed;

(b) means for conveying said elongated metal substrate through the passage way of said fluidized bed on a substantially horizontal pass line; and (c) a power grid for producing a cloud of electrostatically charged particles comprising two co-planar wire mesh elements positioned beneath the surface of the bed, the elements having opposed edges in parallel spaced relationship and defining a gap therebetween beneath said pass line, said edges being upturned to form a plurality of electrode segments, the tips of said electrode segments being substantially coincident with the upper surface of said bed when energized;

whereby said electrode segments form a row of localized corona discharges to either side of said passing substrate to effect electrostatic deposition of a thin uniform film coating of said powdered material thereon.

3. The power grid according to claim 2, wherein said wire mesh elements comprise one-half inch by one-half inch wire mesh.

4. The power grid according to claim 2, wherein said two wire mesh elements are connected to a common surface of high voltage.

5. The power grid according to claim 2, wherein said electrode segments of each said wire mesh element are cut so as to eliminate the longitudinal wire and provide a series of exposed, sharp, pointed wire ends.

6. The power grid according to claim 2, wherein said co-planar wire mesh elements are substantially horizontal and each said upturned electrode segments is substantially perpendicular to its respective wire mesh element.

* * * * *